United States Patent [19]

Allen

[11] 4,331,060

[45] May 25, 1982

[54] MUSICAL INSTRUMENT TUNING DEVICE

[75] Inventor: Ollie J. Allen, Ellicott City, Md.

[73] Assignee: Rex Ollie Allen, Baltimore, Md.

[21] Appl. No.: 195,769

[22] Filed: Oct. 10, 1980

Related U.S. Application Data

[63] Continuation of Ser. No. 24,657, Mar. 28, 1979, abandoned.

[51] Int. Cl.[3] ..... G10G 7/02

[52] U.S. Cl. ..... 84/454; 324/79 D

[58] Field of Search ..... 84/454, 1.16, 1.01; 324/79 D

[56] References Cited

U.S. PATENT DOCUMENTS

| | | | |
|---|---|---|---|
| 2,924,776 | 2/1960 | Peterson | 324/79 |
| 3,180,199 | 4/1965 | Anderson | 84/454 |
| 3,861,266 | 1/1975 | Whitaker | 84/454 |
| 3,901,120 | 8/1975 | Youngquist | 84/454 |
| 3,952,625 | 4/1976 | Peterson | 84/454 |
| 3,968,719 | 7/1976 | Sanderson | 84/454 |
| 4,014,242 | 3/1977 | Sanderson | 84/454 |
| 4,019,419 | 4/1977 | Yoshikawa et al. | 84/454 |
| 4,078,469 | 3/1978 | Coluin | 84/454 |
| 4,271,746 | 6/1981 | Dobbie | 84/454 |

*Primary Examiner*—L. T. Hix
*Assistant Examiner*—Stafford D. Schreyer
*Attorney, Agent, or Firm*—Trexler, Bushnell & Wolters, Ltd.

[57] ABSTRACT

There is disclosed a new and improved device which facilitates the tuning of musical instruments to a standard frequency with speed and accuracy. The device includes an indicating means comprising a plurality of light emitting diodes. The cathode of each diode is coupled to a saturated audio amplifier which is adapted to be coupled either directly to or by a microphone to a musical instrument to be tuned. The anodes of the diodes are coupled to an oscilator which provides any one of a plurality of selectable output frequencies which are harmonically related to a corresponding plurality of standard frequencies. The number of diodes, and the relation between the harmonic oscilator output frequency to the standard frequencies are such that when the instrument is in tune, one half of the diodes appear to be continuously and simultaneously lit. If the instrument is high or low in pitch relative to the selective standard frequency, the diode display will appear to move in first or second respective directions to thereby provide an easily discernable indication as to how the instrument must be adjusted to be brought into tune.

13 Claims, 2 Drawing Figures

MUSICAL INSTRUMENT TUNING DEVICE

This is a continuation of application Ser. No. 24,657, filed Mar. 28, 1979, abandoned.

BACKGROUND OF THE INVENTION

The present invention is directed in general to the tuning of musical instruments and more particularly to a new and improved device which facilitates the tuning of musical instruments to a predetermined standard frequency.

As well known, each instrument of a band, orchestra, or the like must be tuned to a common or related frequency note at frequent intervals to assure that the tunes played by such groups are pleasing to the ear and not in discord. It is not unusual, for example, for such groups to tune their instruments prior to each rehearsal or performance.

At one time the human ear provided the only means by which a note of an instrument could be compared to the pitch of a frequency standard, such as another instrument or audio oscillator. However, in practice, this method was found to be very inaccuracte and unsatisfactory.

Since then, various forms of electronic tuning aids have been proposed. One such aid converts the audible note of the instrument to pulsations of light which are then used to illuminate a rotating strobe disc. Deviation in pitch or frequency of the note from a predetermined standard frequency results in apparent movement of a pattern of light and dark regions on the disc.

Another form of tuning aid includes a frequency counter which displays the frequency of the instrument note. The displayed frequency must be compared to the standard frequency and the instrument adjusted accordingly.

While these tuning aids and others have improved upon the previous devices and methods for tuning musical instruments, there remains substantial room for improvement. For example, prior tuning aids have been very expensive and generally are not affordable by small music groups or individual musicians. Also, prior tuning aids have been relatively inflexible in that they only provide the universal standard frequency of A-4, 440 or a limited number of standard frequencies and have not enabled tuning to an external frequency standard. Furthermore, they have been relatively complicated to use and the indicators which they employ are not always easily readable by untrained users. Lastly, prior tuning devices have not provided a means by which an electric guitar or the like which utilizes an external amplifier may be tuned silently to avoid interruptions of, for example, a performance or rehearsal.

It is therefore a general object of the present invention to provide a new and improved device which facilitates the tuning of musical instruments with speed and accuracy.

It is a further object of the present invention to provide such a device which is substantially less complicated and thus less expensive than prior devices of its kind.

It is a still further object of the present invention to provide such a device which is substantially more flexible to use and which provides plurality of standard frequencies in the form of a plurality of selectable tempered chromatic scale octaves based upon a fixed frequency of A-40, 440 or a variable frequency equal to an external standard frequency, and wherein any one of the individual pitches of the scales may be selected as a standard frequency.

The invention therefore provides a new and improved tuning device for assisting in the tuning of a musical instrument to a predetermined frequency standard. The device includes oscillator means for providing a signal having a frequency which is harmonically related by a preselected even numbered factor to the predetermined frequency, amplifier means adapted to be coupled to the musical instrument and arranged for converting the waveform of the musical instrument output signal to a square-wave signal, and indicating means coupled to the oscillator means and to the amplifier means. The indicating means includes a plurality of light emitting devices, the number of the devices being equal to the preselected factor, and wherein the indicating means is arranged for causing one half of the devices to appear to continuously and simultaneously emit light when the frequency of the musical instrument output signal is equal to the predetermined frequency and for causing different groups of one half of the devices to appear to sequencially and simultaneously emit light when the frequency of the musical instrument output signal is less than or greater than the predetermined frequency to thereby provide a visual indication when the musical instrument is in tune.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawings, in the several figures of which like reference numerals indicate indentical elements, and wherein:

DESCRIPTION OF THE PREFERRED EMBODIMENT

Figure 1:
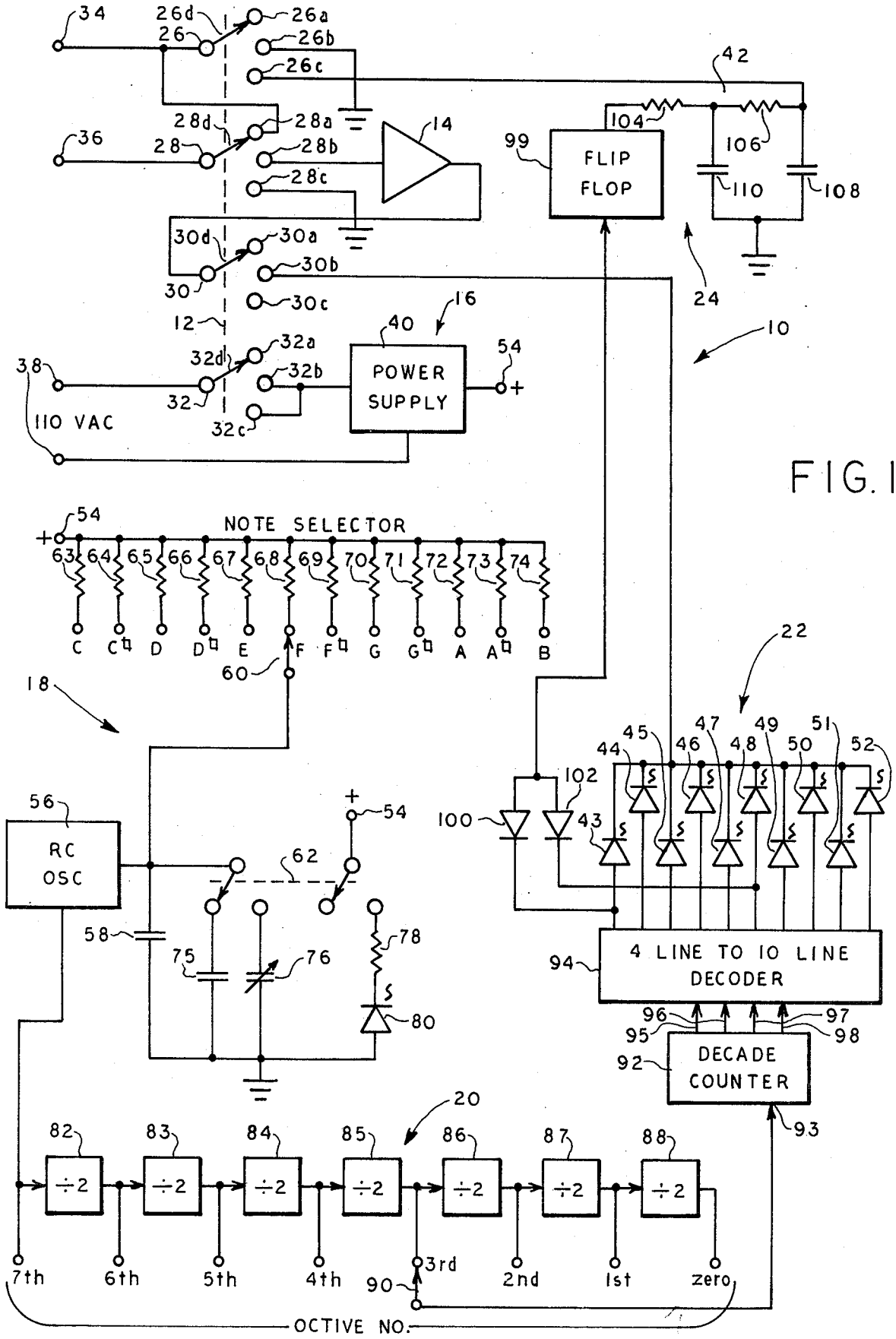
FIG. 1 is a schematic circuit diagram of a musical instrument tuning device embodying the present invention.

Referring now to FIG. 1, the musical instrument tuning device 10 there illustrated generally includes a multiple position switch means comprising a four pole, three position switch 12, a saturated audio amplifier 14, a power source 16, an oscillator 18, a frequency or octave divider section 20, an indicating means 22, and a signal deriving means 24.

The switch 12 as previously mentioned is a four pole three position switch having poles 26, 28, 30, and 32. Each of the poles 26, 28, 30, and 32 are associated with three contact terminals wherein the individual contact terminals are indicated by the reference character of their corresponding pole followed by an appropriate a, b, or c suffix. Additionally, each of the poles 26, 28, 30 and 32 are associated with respective wiper contacts **26*d*, 28*d*, 30*d*, and 32*d*** respectively.

Pole 26 is coupled to an output terminal 34 which is adapted to be coupled to an external amplifier (not shown) of the type which is customarily used in conjunction with an electric guitar or the like for amplifying the notes produced by the electric guitar to render the produced notes audible. Pole 28 is coupled to an input terminal 36 which is adapted to be directly coupled to a musical instrument of the type which utilizes an external amplifier, such as an electric guitar, or coupled by a microphone (not shown) to a musical instrument such as a piano which does not utilize an external amplifier. Pole 30 is coupled to the output of the saturated audio amplifier 14, and pole 32 is coupled to one side of an AC receptacle plug 38 which is adapted to be connected to a house current AC receptacle. The other side of the plug 38 is coupled to the power supply 40 which forms a part of the power source 16.

With respect to the contacts associated with pole 26, pole 26*a* is floating, pole 26*b* is coupled to ground, and pole 26*c* is coupled to the output of a filter 42 which forms a part of the signal deriving means 24. With respect to the contacts associated with pole 28, contact 28*a* is coupled to pole 26, contact 28*b* is coupled to the input of the saturated audio amplifier 14, and pole 28*c* is coupled to ground. With respect to the contacts associated with pole 30, contacts 30*a* and 30*c* are floating, and contact 30*b* is coupled to the cathodes of a plurality of light emitting diodes 43 through 52 which form the indicating means 22. With respect to the contacts associated with pole 32, contact 32*a* is floating, and contacts 32*b* and 32*c* are coupled to the power supply 40. The power supply 40 has an output terminal 54 which of course is coupled to the various active elements of the musical instrument tuning device in accordance with customary practice.

The oscillator 18 includes an RC oscillator circuit 56. The circuit 56 is of the type which oscillates at a frequency determined by the values of impedance and capacitance elements coupled thereto. To that end, the circuit 56 is coupled to a capacitor 58 and to a pair of switches including a single pole, twelve positioned switch 60 and a double pole; two position switch 62. The switch 60 includes a plurality of contacts which are coupled to the power supply terminal 54 by respective impedance elements or resistors 63 through 74. The other switch 62 has a first pair of contacts which are coupled to ground by a fixed capacitor 75 or a variable capacitor 76 depending upon the position of switch 62. Switch 62 has another pair of contacts, one of which is floating corresponding to the first position of switch 62, and the other one of which is coupled to ground by a resistor 78 and light emitting diode 80.

The oscillator 18 by virtue of the values of resistors 63 through 74 and capacitors 58, 75, and 76, cause the oscillator 18 to provide an output signal having a frequency which is 10 times the frequency of a given predetermined standard frequency to which an instrument is to be tuned. More specifically, each of the resistors 63 through 74 corresponds to a respective note of an equal tempered chromatic scale. When switch 62 is in its first position as shown, the fixed capacitance element 75 causes the chromatic scale obtainable upon rotation of switch 60 to be based upon a fixed frequency corresponding to the A-4, 440 universal standard. When switch 62 is in its second position, the variable capacitance element 76 will cause the chromatic scale produced by the oscillator as switch 60 is rotated to be based upon an adjustable frequency. Preferably, the mid-capacitance value of variable capacitance element 76 is equal to the capacitance value of capacitor 75 so that the adjustable range of frequencies is centered on the frequency standard A-4, 440, and adjustable above and below that frequency. The purpose of the variable capacitance element 76, as will be more fully described hereinafter, is to enable the musical instrument tuning device of FIG. 1 to tune an instrument to an external standard frequency other than the fixed A-4, 440 frequency. When switch 62 is in its second position, the resistor 78 and light emitting diode 80 will be connected upon the positive power supply terminal 54 and ground so that the light emitting diode 80 will be lit to warn the user that the frequency standard upon which the tuning of the instrument is based is an adjusted frequency corresponding to an external frequency standard.

The octave divider section 20 comprises a plurality of frequency dividers 82 through 88. The dividers 82 through 88 are serially connected together.

Switch 90 is a single pole, eight positioned switch which enables the selection of respective serial groups of the frequency dividers to provide oscillator frequencies corresponding to eight different octaves. As a result, by virtue of the octave dividers 82 through 88, the oscillator 18 is enabled to provide an equal tempered chromatic scale for eight different octaves upon selective positioning of switch 90, and any one of the notes within the chromatic scales responsive to the selective positioning of switch 60.

As previously mentioned, the oscillator 18 provides its output frequencies which are ten times greater in frequency than the selectable standard frequencies to which the musical instrument may be tuned. Of course, as will be made clear subsequently, the output frequencies of oscillator 18 may be harmonically related to the corresponding standard frequencies by any even numbered factor.

The switch 90, and thus the oscillator 18, is coupled to the indicating means 22 by a decade counter 92 and a four line to ten line decoder 94. The decade counter 92 has an input 93 which is coupled to the pole of switch 90 and four outputs 95 through 98 which are coupled to respective ones of the inputs of decoder 94. The decoder 94 in turn has ten outputs with respective given ones of the outputs of decoder 94 being coupled to a respective one of the anodes of light emitting diodes 43 through 52 respectively.

Figure 2:
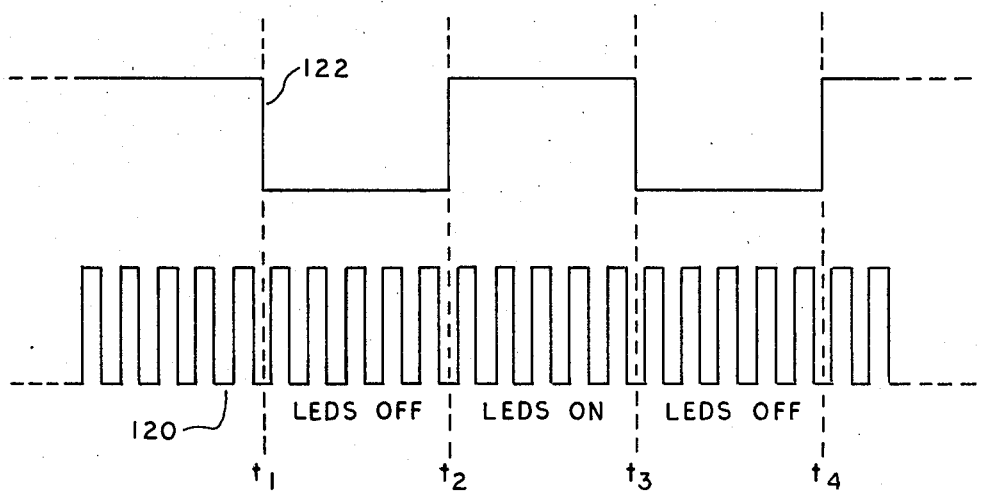
FIG. 2 illustrates graphical representations of waveforms generated within the device of FIG. 1 and which may be utilized hereinafter for gaining a better understanding of the operation of the embodiment of FIG. 1.

By virtue of this arrangement, each of the light emitting diodes 43 through 52 will have impressed upon their respective anodes a waveform signal as illustrated by the waveform 120 of FIG. 2. Each of the anodes will receive such a signal waveform, with the only difference between the waveform received by the various diodes being that each successive diode will receive a waveform which is delayed by one pulse of oscillator 18.

Because the oscillator oscillates at a frequency which is ten times greater in frequency than the given predetermined standard frequency to which the musical instrument is to be tuned, a signal deriving means 24 is provided for deriving from the oscillator signal impressed upon the diodes 43 through 52 an output signal which is equal in frequency to the desired standard frequency to which the musical instrument is to be tuned. To that end, the signal deriving means 24 includes a flip-flop 99, a pair of diodes 100 and 102, and the filter 42 which comprises resistors 104 and 106, and capacitor 108 and 110. The input to flip-flop 99 is coupled to the first output of decoder 94 by diode 100 and to the sixth decoder output by diode 102. The output of flip-flop 99 is coupled to the contact 26*c* of switch 12 by the filter 42. As a result of this arrangement of flip-flop 99 and diodes 100 and 102, the output of flip-flop 99 will be a square wave having a frequency equal to the predetermined standard which the instrument is to be tuned. More specifically, because the diodes 100 and 102 are coupled to the first and sixth outputs of decoder 94, the frequency of the oscillator 18 will be divided by a factor of 10. Since the oscillator was caused to oscillate at a frequency ten times greater in frequency than the desired standard frequency, the output of flip-flop 99 will be equal in frequency to the desired standard frequency. The filter 42 serves to round off the square wave produced by the flip-flop 99 to provide a pleasing tone.

In operation, when the switch 92 is in its first position as shown, the wiper **26*d* will be in engagement with contact 28*a*, and wiper 30*d* will be in engagement with contact 30*a*. In this switch position, the tuning device will be off. The musical instrument coupled to the input terminal 36 will be connected to the output terminal 34. Hence, if the instrument coupled to the tuning device is an electric guitar which normally utilizes an external amplifier, it will be directly coupled to its external amplifier through the switch 12. Of course, should the instrument be a piano or some other instrument of the type which does not utilize an external amplifier, since this type of instrument would be coupled to terminal 36 by a microphone or the like, a direct connection to an external amplifier would be unnecessary. Also in this switch position, it can be noted that the wiper 32*d* is in engagement with contact 32*a* thus disconnecting the power supply 40 from the AC receptacle plug 38**. Hence, no power will be applied to the tuning device.

When the switch 12 is advanced to its second position, wiper **26*d* will be in engagement with contact 26*b*, wiper 28*d* will be in engagement with contact 28*b*, wiper 30*d* will be in engagement with contact 30*b*, and wiper 32*d* will be in engagement with contact 32*b*. In this switch position, the terminal 34 coupled to the input to the external amplifier of the musical instrument is grounded to prevent any signal from reaching the external amplifier. As a result, tuning of the instrument is permitted during a performance or a rehearsal without interference. The terminal 36 which is coupled to the musical instrument is connected to the input of the saturated audio amplifier 14 and the wiper 30*d* provides connection between the output of the saturated audio amplifier 14 and the cathodes of the light emitting diodes 43 through 52. Lastly, because wiper 32*d* is in engagement with contact 32*b*, the AC receptacle plug 38 will thereby be connected to the power supply 40 so that the power source 16 provides activating power to the various active components of the tuning device at its terminal 54**.

As a result, when switch 12 is in this second position, the tuning device is activated and ready to facilitate the tuning of a musical instrument. In tuning the musical instrument, the user first selects the given predetermined frequency to which the musical instrument is to be tuned. For example, should the user desire to tune the instrument to, for example, the universal standard frequency A-4, 440, the user merely positions switch 60 to connect the resistor 72 corresponding to that note to the RC oscillator circuit 56. Since the standard frequency is to be internally generated by the tuning device, switch 62 will be set to select the fixed capacitor 75. Further, the user selects the appropriate octave by the switch 90, in this case the 3rd octave, the output of divider 85. As a result of the foregoing, the oscillator 18 will be caused to provide an output frequency which is ten times greater in frequency than the A-4, 440 frequency. In other words, the oscillator 18 will provide the decade counter 93 with an output signal having a frequency of 4,400 cycles per second.

Once the oscillator 18 has been properly conditioned, the user then produces the corresponding note on the instrument. The waveform of the note produced by the instrument is converted to a square wave by the saturated audio amplifier 14 which is then impressed upon the cathodes of light emitting diodes 43 to 52 through the wiper **30*d* of switch 12. As a result, the cathodes of the light emitting diodes will see a waveform as depicted in FIG. 2 and identified as 122. If the instrument is in tune to the selected A-4, 440 frequency standard, the relative positions of the waveforms 120 and 122 as shown in FIG. 2** will ensue.

It will be noted from FIG. 2 that during the time periods between $t_2$ and $t_3$, five out of the ten light emitting diodes will be lit, and during the time period between $t_1$ and $t_2$, or $t_3$ and $t_4$, the other five light emitting diodes will be off. Hence, when the frequency of the instrument to be tuned is exactly one tenth of the oscillator frequency, five of the light emitting diodes will be lit during the positive half cycle of the input signal from the instrument and five will be off. Because the same light emitting diodes are continuously activated at the frequency of decoder 94, a "picket fence strobe" effect results with the picket fence being stationary. However, when the incoming signal from the musical instrument is not exactly one tenth of the oscillator frequency, the picket fence is caused to appear to move. In other words, different groups of one half of the light emitting diodes will appear to sequentially and simultaneously emit light when the frequency of the musical instrument signal is less than or greater than the predetermined frequency standard.

Preferably, the light emitting diodes 43 through 52 are arranged linearly or in line. Hence, when the musical instrument is slightly out of tune, the movement of the picket fence will be readily apparent. The speed and direction of movement of the picket fence is in direct relationship to the number of cycles that the musical instrument signal is off or deviates from the predetermined standard frequency. The picket fence will appear to move to the right from light emitting diode 43 to light emitting diode 52 the same number of times in a second that the instrument signal is high in frequency. When the instrument signal frequency is low in frequency, the picket fence moves to the left from diode 52 to diode 43 in the same manner.

If the user desires to check the frequency of some other note of the instrument, that note may be merely selected by the switch 60. When the user then produces a corresponding note on the instrument, the tuning of the instrument to that new note is accomplished in the same manner as described above.

If it is desired to tune the instrument to an externally produced frequency standard, the user merely disconnects the instrument from the terminal 36 and connects the external frequency standard producing device to the terminal 36. The switch 62 is then placed in its second position which selectively connects the variable capacitance element 76 to the oscillator circuit 56 and causes the light emitting diode 80 to light thus warning that the standard frequency to which the instrument will be tuned is based upon an external standard frequency. The external standard frequency is then introduced into the saturated audio amplifier 14, and the value of variable capacitance element 76 is adjusted until the picket fence created by light emitting diodes 43 through 52 appears to be stationary as explained above. It is to be noted that in establishing the standard frequency responsive to an external standard, the values of resistors 63 through 74 were not changed. As a result, the chromatic scales enabled to be produced by the oscillator 18 will be based upon the adjusted frequency as determined by capacitator 76 but retains the standard relationship between each note of the chromatic scale.

When switch 12 is advanced to its third position, wiper **26*d* will engage contact 26*c*, wiper 28*b* will engage contact 28*c*, wiper 30*d* will engage contact 30*c*, and wiper 32*d* will engage contact 32*c*. In this switch position, the tuning device power supply is activated to energize the tuning device, the instrument connected to terminal 36 is grounded to prevent stray pickup, the output of the saturated audio amplifier 14 is disconnected from the light emitting diodes 43 through 52 to prevent their activation and to conserve power should the power source be a battery, and the signal deriving means 24 is connected to terminal 34 which is in turn coupled to the input of the external amplifier. Hence, in this switch position, an audible tone having a frequency equal to the desired frequency may be produced. The filter 42 comprises an audio filter which rounds out the square wave signal received from the decoder 94 so that the audible tone has improved tonal qualities. The filter 42** additionally reduces the amplitude of the derived signal to approximately the level produced by a microphone or electric music instrument so that no change in amplifier gain setting is required when switching to this position.

From the foregoing, it can be appreciated that the present invention provides a new and improved device which facilitates the tuning of a musical instrument to a standard frequency with speed and accuracy. The tuning device is substantially less complicated than those of the prior art and covers a frequency range of 12 notes of an equal tempered chromatic scale in eight octaves and is adaptable to operate on self-contained rechargeable batteries. Either an internal frequency standard based upon the A-4, 440 universal standard or any external frequency may be used as a base to tune instruments using the present invention. Furthermore, as a convenience, when the device is turned off, an electric music instrument will be directly connected to its associated external amplifier. This is an important feature when a stringed instrument becomes detuned or breaks a string during the playing of a performance. To retune, the tuning device is merely turned on, disconnecting the instrument from its amplifier, the string is tuned, and the tuning device is turned off thus reconnecting the instrument with its amplifier for use.

As a further feature of the present invention, an external frequency standard may be accommodated. After the variable capacitance element has been appropriately adjusted, all 96 tones available from the oscillator will be based upon the one external tone. If a tone which is accurate in frequency is desired from the external amplifier, the internal frequency standard may be switched into the amplifier.

Lastly, the tuning device of the present invention provides a display which is easy to read even from a distance. When the instrument is in tune, it can be readily discerned that the picket fence created by the indicator is stationary and when the instrument is slightly out of tune, the direction and speed of movement of the picket fence facilitates rapid adjustment of the instrument.

While a particular embodiment of the present invention has been shown and described, modifications may be made, and it is therefore intended to cover in the appended claims all such changes and modifications which fall within the true spirit and scope of the invention.

The invention is claimed as follows:

1. A device for use in tuning the frequency of a musical instrument output signal to a given predetermined frequency comprising an oscillator and a plurality of impedance elements each of which may be coupled to the oscillator for enabling said oscillator to provide a corresponding plurality of output frequencies which are predetermined even-numbered multiples of a corresponding plurality of respective predetermined frequencies comprising an equal tempered chromatic scale of frequencies including said given predetermined frequency, a fixed capacitance element, a variable capacitance element, and capacitance selection switch means for coupling said fixed capacitance element to the oscillator to provide a fixed frequency upon which said equal tempered chromatic scale is based or for coupling said variable capacitance element to said oscillator to provide a variable frequency upon which said equal tempered chromatic scale is based, said variable capacitance element having a midrange capacitance value equal to the capacitance value of said fixed capacitance element to permit the varying of said frequency upon which said chromatic scale is based above or below said fixed frequency; selector means for coupling one of said impedance elements to the junction of the oscillator with the selected capacitance element for causing said oscillator to provide an output frequency which corresponds to said given predetermined frequency; an amplifier adapted to be coupled selectively to one of the musical instrument output signal and an external frequency standard signal and arranged to convert the waveform of the signal coupled thereto to a square wave; and indicating means including a plurality of light-emitting diodes, each having an anode and a cathode, the anodes of said light-emitting diodes being coupled to said oscillator and the cathodes of said light-emitting diodes being coupled to said amplifier, said indicating means being arranged for causing said light-emitting diodes to emit light for indicating when the frequency of the oscillator exactly equals the predetermined multiple of the frequency of the signal coupled to said amplifier thereby selectively permitting either tuning of said musical instrument in accordance with said fixed frequency or tuning of said oscillator in accordance with said external frequency standard signal.

2. A device as claimed in claim 1 comprising a plurality of frequency dividers serially coupled to said oscillator, and wherein serial groups of said dividers are selectable for providing said indicating means with a corresponding plurality of selectable octaves of said chromatic frequency scale.

3. A device as defined in claim 1 wherein the musical instrument to be tuned is of the type which includes an external amplifier for amplifying the frequency signals produced thereby, wherein said device further includes a power source for energizing said device and multiple position switch means arranged for simultaneously coupling said musical instrument to its external amplifier and disconnecting said power source from said device when said switch means is in a first position.

4. A device as defined in claim 3 wherein said switch means is further arranged for simultaneously connecting the external amplifier to ground potential, connecting said musical instrument to said amplifier, connecting said amplifier to said indicating means light emitting means and connecting said power source to said device when said switch means is in a second position.

5. A device as defined in claim 4 wherein said device further includes signal deriving means for deriving an output signal from said oscillator having a frequency equal to said given predetermined frequency, and wherein said switch means is further arranged for simultaneously connecting said external amplifier to said signal deriving means, for connecting the musical instrument to ground potential, for disconnecting said amplifier from said indicating means, and for connecting said power source to said device when said switch means is in a third position whereby said external amplifier is enabled to amplify said derived signal to provide an audible tone having a frequency equal to said given predetermined frequency.

6. A device as defined in claim 1 wherein said plurality of light emitting diodes comprise ten light emitting diodes.

7. A device as defined in claim 6 further including a decade counter having an input and four outputs, and a four line to ten line decoder having four inputs and ten outputs, wherein said decade counter input is coupled to said oscillator, wherein said decade counter outputs are coupled to said decoder inputs, and wherein each said decoder output is coupled to a respective one of said diode anodes.

8. A device as defined in claim 7 further including signal deriving means coupled to a pair of said decoder outputs for deriving an output signal having a frequency equal to said given predetermined frequency.

9. A device as defined in claim 8 wherein said signal deriving means comprises a flip-flop having an input coupled to said pair of decoder outputs and filter means coupled to said flip-flop for smoothing the signal waveform of said flip-flop and reducing its amplitude.

10. A device as defined in claim 9 further including a pair of diodes coupling said flip-flop to said pair of decoder outputs.

11. A device as defined in claim 1 further including display means coupled to said capacitance selection switch means for providing an indication when said variable capacitance element has been selected.

12. A device as defined in claim 11 wherein said display means comprises a light emitting diode for providing a visual indication when said variable capacitance element has been selected.

13. A device for use in tuning the frequency of a musical instrument output signal to a given predetermined frequency comprising an oscillator including a plurality of impedance elements enabling said oscillator to provide a corresponding plurality of output frequencies which are greater in frequency by a predetermined even-numbered factor than a corresponding plurality of respective predetermined frequencies including said given predetermined frequency; selector means for selecting said impedance elements for causing said oscillator to provide an output frequency; an amplifier adapted to be coupled to the musical instrument output signal and arranged to convert the waveform of said output signal to a square wave; and indicating means including a plurality of two-terminal light emitting devices of the same number as said predetermined even-numbered factor, one terminal of each said light emitting device being coupled to said amplifier, and circuit means coupled intermediate said oscillator and the other terminal of each of said light emitting devices and arranged for causing a group of said light emitting devices to appear to continuously and simultaneously emit light for indicating when said musical instrument output equals the given predetermined frequency, wherein said circuit means includes a counter having an input and a given number of outputs, and a decoder having said given number of inputs and a plurality of outputs equal in number to said predetermined even-numbered factor, wherein said counter outputs are coupled to said decoder inputs, and wherein each said decoder output is coupled to a respective one of said other terminals of said light emitting devices, and signal deriving means coupled to predetermined ones of said decoder outputs for deriving an output signal having a frequency equal to said given predetermined frequency.

* * * * *